US007942242B1

(12) United States Patent
O'Connor et al.

(10) Patent No.: US 7,942,242 B1
(45) Date of Patent: May 17, 2011

(54) URBAN EMERGENCY ESCAPE METHOD AND SYSTEM

(76) Inventors: Daniel J. O'Connor, Great Falls, VA (US); John S. Soltys, Falls Church, VA (US)

( * ) Notice: Subject to any disclaimer, the term of this patent is extended or adjusted under 35 U.S.C. 154(b) by 783 days.

(21) Appl. No.: 11/798,346

(22) Filed: May 14, 2007

(51) Int. Cl.
*A62B 1/00* (2006.01)

(52) U.S. Cl. ..... 182/70; 182/3; 182/5; 182/7; 182/53; 182/189

(58) Field of Classification Search ..... 182/3, 5, 182/7, 53, 57, 70, 189, 206; 248/229.15, 248/499; 206/389, 388, 479, 483
See application file for complete search history.

(56) References Cited

U.S. PATENT DOCUMENTS

| | | | | | |
|---|---|---|---|---|---|
| 119,008 | A | * | 9/1871 | Bishop et al. | 182/3 |
| 192,364 | A | * | 6/1877 | Duncan | 182/196 |
| 256,874 | A | * | 4/1882 | Borgfeldt | 182/190 |
| 293,137 | A | * | 2/1884 | Bennett | 182/39 |
| 396,552 | A | * | 1/1889 | Elsbury | 182/195 |
| 504,850 | A | * | 9/1893 | Ponickau | 190/102 |
| 632,226 | A | * | 8/1899 | Menges | 182/70 |
| 1,351,734 | A | * | 9/1920 | Barrington | 182/5 |
| 2,436,402 | A | * | 2/1948 | Potter | 254/134.3 R |
| 3,344,886 | A | * | 10/1967 | Boscarino, Jr. | 182/70 |
| 3,419,236 | A | * | 12/1968 | Weber | 244/151 R |
| 4,079,811 | A | * | 3/1978 | Driskell | 182/35 |
| 4,102,431 | A | * | 7/1978 | Carroll et al. | 182/5 |
| 4,327,887 | A | * | 5/1982 | Kumakura | 248/73 |
| 4,480,716 | A | | 11/1984 | Soubry et al. | |
| 4,508,193 | A | * | 4/1985 | Forrest | 182/5 |
| 4,550,801 | A | | 11/1985 | Forrest | |
| 4,583,616 | A | * | 4/1986 | Baker | 182/49 |
| 4,588,045 | A | | 5/1986 | Walker, Sr. | |
| 4,616,735 | A | | 10/1986 | Orgeron | |
| 4,662,517 | A | * | 5/1987 | Wirth | 206/388 |
| 4,913,136 | A | * | 4/1990 | Chong et al. | 602/24 |
| 5,056,619 | A | * | 10/1991 | Darnell et al. | 182/5 |
| 5,107,956 | A | | 4/1992 | Constantinis | |
| 5,265,696 | A | * | 11/1993 | Casebolt | 182/8 |
| 5,628,380 | A | * | 5/1997 | Matisi | 182/70 |
| 5,690,187 | A | | 11/1997 | Wang et al. | |
| 5,740,885 | A | * | 4/1998 | Paradise | 182/190 |
| 5,868,219 | A | | 2/1999 | Sadeck | |
| 5,927,450 | A | * | 7/1999 | Sadow | 190/102 |
| 6,102,128 | A | * | 8/2000 | Bridgeman | 169/49 |
| 6,382,352 | B1 | * | 5/2002 | Dowe, Sr. | 182/70 |

(Continued)

*Primary Examiner* — Katherine Mitchell
*Assistant Examiner* — Colleen M Quinn
(74) *Attorney, Agent, or Firm* — Walker & Jocke

(57) ABSTRACT

The invention relates to an urban emergency escape method and apparatus for use in escaping from high-rise buildings. The method sets forth a series steps that allows one to successfully evacuate a high-rise building that is filled with smoke due a fire or the elevator system is not working due to an explosion or a terrorist attack of some kind. The apparatus utilized comprises a carry-on bag with a handle and wheels for easy mobility and a zippered cover that encloses a plurality of interconnected rope sections, a descent controller, a plurality of anchoring straps, at least one harness, D-rings and a glass breaking tool. After donning the harness and breaking the window to allow exit, the anchoring straps are secured to several different structural components within the room and tied to a first end of a rope segment. The free end of the rope segment is pre-fed through the descent controller, the user steps out the broken window and allows evacuee to descend by manipulating the descent controller.

22 Claims, 7 Drawing Sheets

U.S. PATENT DOCUMENTS

| | | | | |
|---|---|---|---|---|
| 6,817,443 | B1 | 11/2004 | Metz | |
| 6,823,966 | B1 | 11/2004 | Henson | |
| 6,837,337 | B2 | 1/2005 | Thomas et al. | |
| 6,962,235 | B2 | 11/2005 | Leon | |
| 6,988,589 | B2 | 1/2006 | Ribic | |
| 7,634,830 | B2 * | 12/2009 | Ryan | 7/166 |
| 2004/0055824 | A1 | 3/2004 | Karnes | |
| 2006/0163000 | A1 | 7/2006 | Chowthi | |

* cited by examiner

URBAN EMERGENCY ESCAPE METHOD AND SYSTEM

BACKGROUND OF THE INVENTION

The present invention relates to equipment that can be readily used in escaping from a high rise building, i.e. one in excess of twenty stories high, when the usual stairways and elevator systems are not available due to some emergency situation. More specifically, it relates to the equipment utilized and also the method of using the equipment to expeditiously evacuate a building under adverse conditions. There are several situations where a person on the upper floors, for example, $30^{th}$ floor, could become trapped at that level due to a fire, bomb, explosion or other condition where the elevators and the stairways are not available due to the presence of smoke, fire or possibly hostile persons. In addition, the present invention also relates to the method of using the equipment to allow for successful evacuation of someone trapped at that level under these conditions. The usefulness of this invention has been highlighted by the tragic events of Sep. 11, 2001 when the terrorists took control of a plurality of aircraft and flew them into the Twin Towers of New York City. It can readily be seen that provision of the Twin Towers with equipment such as disclosed herein would have resulted in the saving of many lives.

SUMMARY OF THE INVENTION

The present invention relates to equipment that can be readily moved about from place to place in a convenient carry-on bag with wheels and a pull handle which provides storage for a plurality of ropes lengths, at least one harness, a plurality of anchoring straps, and a descent controller for controlling the rate of descent by the user. Additionally, the carry-on bag would contain a piece of equipment that would be utilized for the controlled breaking of windows in the room, allowing for the escape there through.

Once it is decided that this escape equipment is to be utilized, the carry-on bag is opened, the one or three anchor straps are secured, the harness is donned and the window breaking tool is removed from the carry-on bag and utilized to break the window of the particular room the user is located in. The descent controller is attached to the first length of rope in the carry-on bag and the carry-on bag with the remaining lengths of rope and weights therein thrown from the room through the broken window to the ground in preparation for the user to attach his harness to the rope and proceed to descend through careful use of the controller.

In this example, a single person was lowered through the use of the escape equipment; however, there are situations where a second, inexperienced or otherwise, person could be lowered with the same equipment. In this situation, the second person would be equipped with a harness that is securely attached to the harness of the experienced used and the experienced person would be the person-in-charge, with the second person riding tandem to the first person.

DISCUSSION OF THE PRIOR ART

A recent search of the Patent Office files in the appropriate Class and subclasses revealed the following prior art:

| | | | | |
|---|---|---|---|---|
| 4,480,716 | 4,550,801 | 4,588,045 | 4,616,735 | 5,107,956 |
| 5,690,187 | 5,868,219 | 6,817,443 | 6,823,966 | 6,837,337 |
| 6,962,235 | 6,962,238 | 6,988,589 | 2004/0055824 | 2006/0163000 |

With regard to the above noted search of the Patent Office Files, Oregron, '735; Henson, '966; Thomas et al, '337; Ostrobrod, '238; Leon, '235; Constantinis et al, '956; Soubry et al, '956 and '716; Walker, '045; and Forrest, '801 are each directed to descent controllers for controlling the rate of descent. Metz, '443 discloses the use of an aluminum track attached to the outside portion of the building wherein a clamp device engages the track permitting the user to descend to the ground. Rible, '589 the user dons a harness and a container containing a length of rope, provision is made whereby the user may use both hands freely. Published applications '824 and '000 each disclose systems wherein the user controls the rate of descent in evacuating a high-rise building during an emergency situation. Wang et al, '187 discloses a travel bag made of a coiled rope body, fastening straps and a speed control means for controlling the rate of descent. Sadeck, '219 discloses a rope storage and deployment system per se.

OBJECTS OF THE INVENTION

An object of the invention is to provide a portable apparatus for safe evacuation of high-rise building in an emergency situation.

Another object of the invention is to provide a method of using this equipment in the evacuation of a high-rise building in an emergency situation.

A further object of the invention is the provision of a carry-on bag that is portable and contains all the equipment that is necessary for the expeditious and simultaneous descent of plural persons.

A still further object of the invention is the provision of tools that assist in the controlled breaking of windows (if necessary) of the building for exiting purposes.

Yet another object of the invention is to provide a descent controller that allows for finger control of the rate of descent where the controller automatically brakes should the evacuee remove his hands from the descent controller.

A further object of the invention is to provide a carry-on bag that includes the necessary rope, harnesses, anchor straps, descent controller and other components required for a successful evacuation of a building under siege.

A still further object of the invention is to provide an anchoring clamp that is readily mounted in a minimum amount of time.

These and other objects of the invention will become more apparent hereinafter. The instant invention will now be described with reference to the accompanying drawings wherein like reference characters designate the corresponding parts throughout the several views.

DETAILED DESCRIPTION OF THE DRAWINGS

Figure 1:
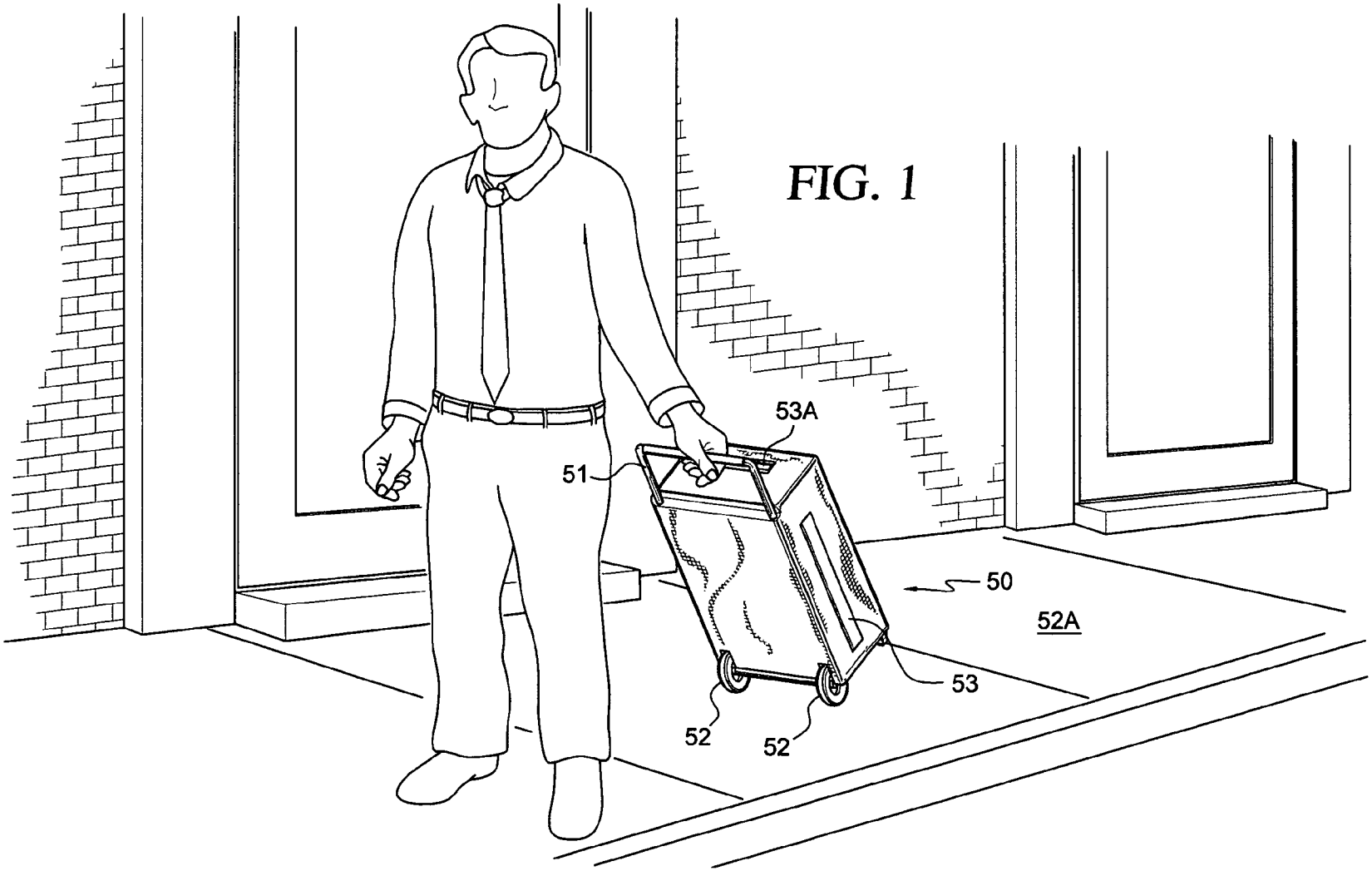
Referring now to FIG. 1, there is shown an elevational view of the portable carry-on bag that contains all the equipment for the prompt exiting of an emergency evacuation.

Referring now to FIG. 1, there is shown an elevational view of the portable carry-on bag 50 with its extendable pull-handle 51 extended for easy mobility as one hustles through crowded airport terminals. Portable carry-on bag 50 is an FAA certified bag that has been certified as "carry-on luggage" when boarding U.S. aircraft and certified for stowage either in the overhead storage bin or beneath the seat stowage. As shown, carry-on bag 50 is provided with a pair of ground engaging wheels 52 that allow for smooth rolling contact with the floor 52A. Carry-on bag 50 is also provided with a handle 53 for use when use of the pull-handle 51 would not be convenient, such as when trying to stow the bag in an overhead storage bin. A third handle 53A, located at one end of carry-on bag 50 is also useful in manipulating bag 50 when stowing. As shown, all the necessary equipment necessary for an emergency evacuation is stowed within carry-on bag 50 ready for use in a moments notice.

Figure 2:
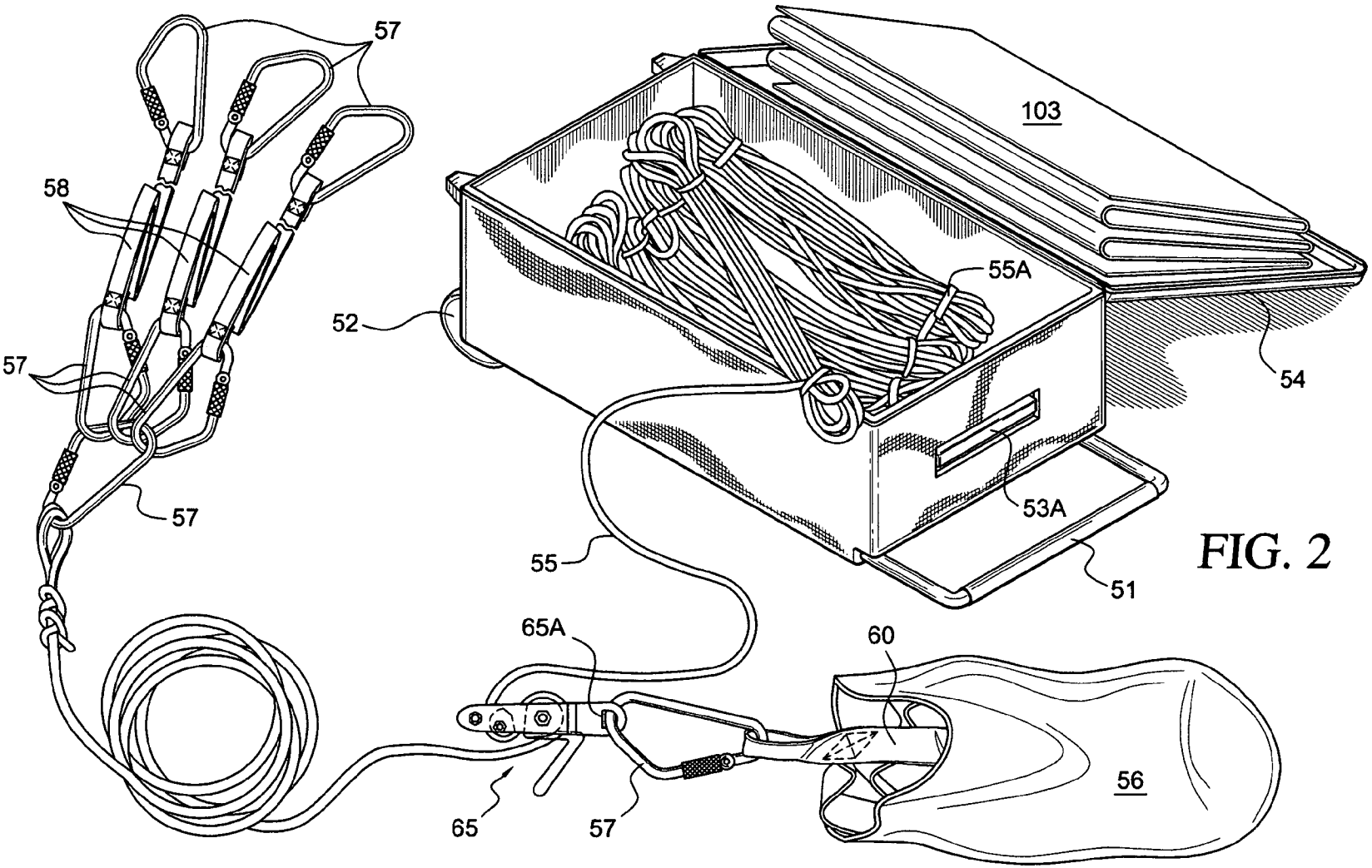
FIG. 2 is a plan view with the portable carry-on bag open displaying its contents on the floor.

Turning now to FIG. 2, there is shown the portable carry-on bag 50 positioned on the floor with its lid 54 unzipped and exposing the contents of carry-on bag 50. As shown, all of the contents have been removed from the interior of carry-on bag 50 except some 200 feet of pre-rigged rope into a plurality of bundles that are kept straight by the positioning of rubber bands 55A near opposite ends of the rope 55. The terminal end of rope 55 is securely fastened to the inside of carry-on bag 50 (not shown) and after it is thrown outside the exit portal, it automatically unravels itself during descent, popping the rubber bands 55A, with the carry-on bag 50 acting as a rope stabilizer. As can be seen, rope 55 is rigged into a plurality of continuous bundles and shown with a portion thereof exiting the carry-on bag 50 onto the floor where descent controller 65 is shown attached to rope 55 by the rope 55 passing through descent controller 65. There is also shown a nylon bag 56 which is used to store the harnesses which are not visible since they are inside nylon bag 56. A locking carabiner 57 connects to the rescue harness 60. Rope 55 continues to the point where another carabiner is attached to three more carabiners 56 which are attached to one end of anchor straps 58. Three anchor straps 58 are usually used when there is a dual descent, i.e. two persons descend simultaneously. As shown, there are three such straps 58 with locking carabiners 56 attached to each end thereof, the function of these anchor straps will described in more detail later.

There still remains a couple of pieces of equipment that are contained in the portable carry-on bag 50 that are not illustrated in this figure, namely, the harnesses for both single and dual evacuation and also a window breaking tool utilized for breaking the window in preparation for exit therethrough.

Figure 3:
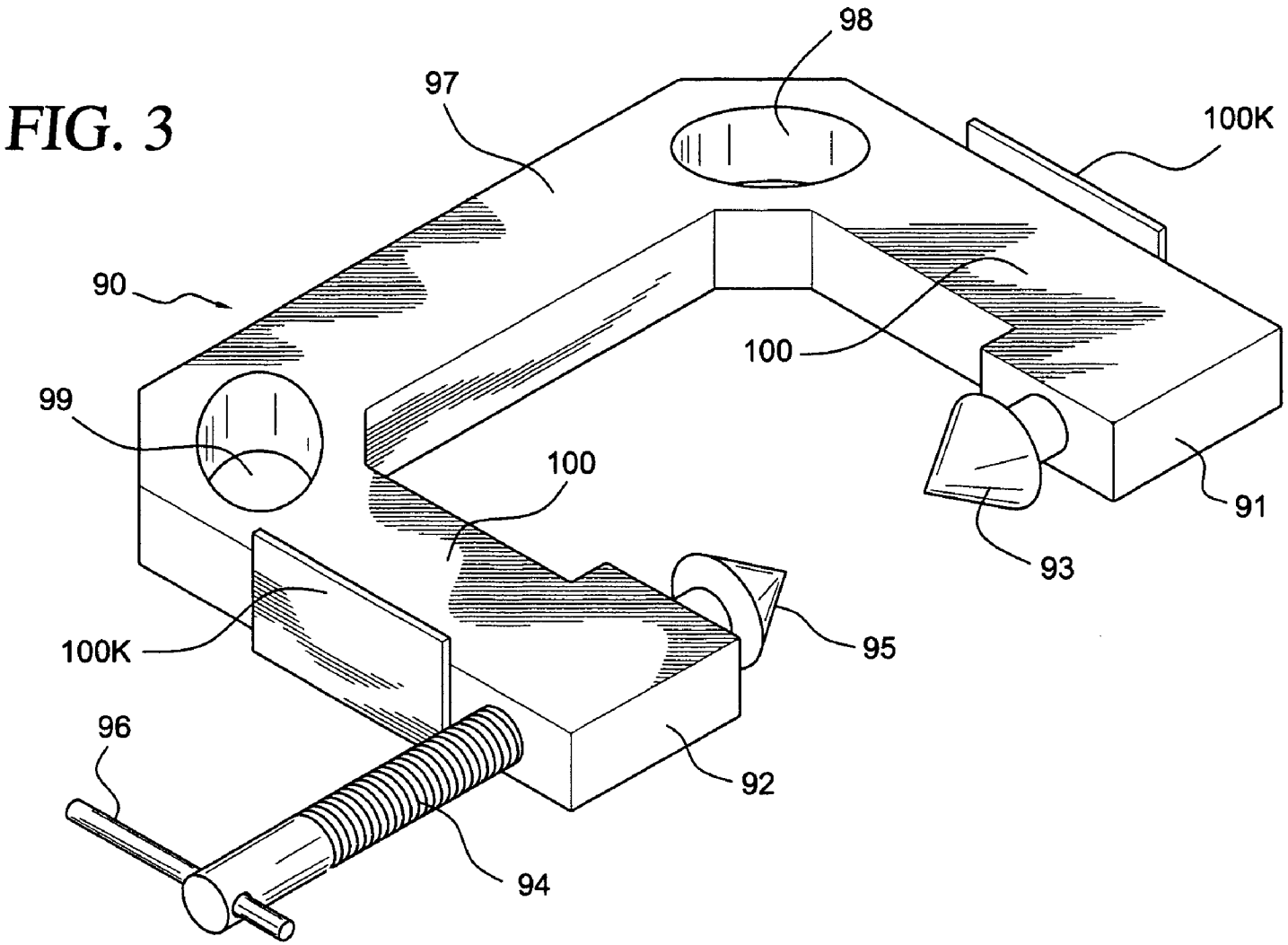
FIG. 3 is an illustration of the anchor clamp utilized when only a single person is evacuating a building in an emergency situation.

FIG. 3 is an illustration of the anchor clamp 90 that is used for quick attachment of the rope 55 when there is a "one person" evacuation. In the instance of a single evacuation, the total weight load on the ropes 55 is less; therefore, the anchoring of rope 55 can be satisfied with the use anchor clamp 90. As illustrated, anchor clamp 90 is generally "C"-shaped with inwardly turned first and second ends 91 and 92. First end 91 includes a fixed pointed head member 93 pointed inwardly while second end 92 is provided with a threaded rod 94 that terminates with another pointed head 95 directly opposite of first pointed head 93. A lever 96 extends through threaded rod 94 and is used to bring second pointed head 95 into close engagement with a stationary member such as a door jamb 14 shown in FIG. 9. Opposite ends of vertical portion 97 are proved with first and second opening 98 and 99. The purpose of these openings is to attach the anchor carabiners 57, as shown in FIG. 2. Kick plates 100K are provided on the outer portions to assist the "C" clamp in penetrating the wall around the door frame.

Figure 4:
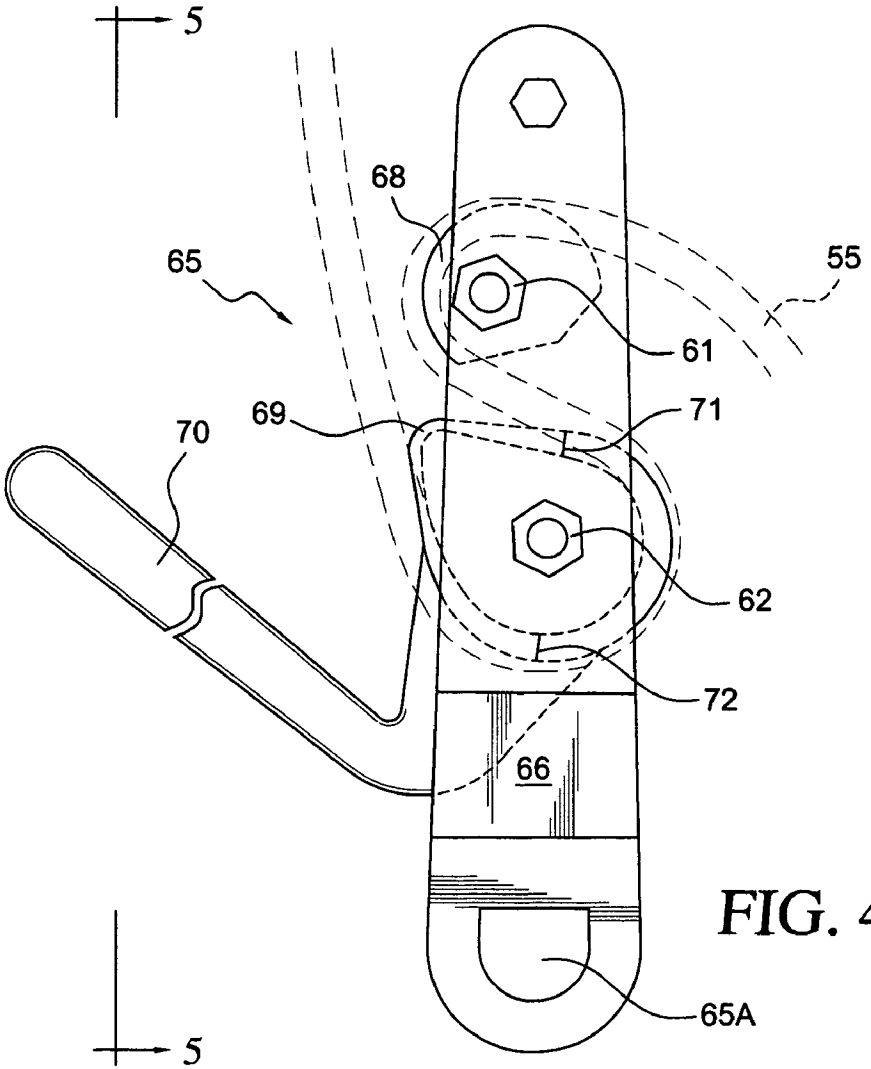
FIG. 4 is a plan view of the descent controller that controls the rate of descent.

Referring now to FIG. 4, there is shown a plan view of the descent controller 65. As shown, the descent controller 65 comprises an upper plate 66 and lower plate 67 (not shown in this view) with a pair of friction cams 68, 69 sandwiched there between by a pair of bolts 61, 62. Upper cam 68 has a rope receiving groove 68A. Lower cam 69 includes a lever portion 70 extending from a portion thereof that is used for rotating lower cam 69 into and out of its locked/released positions. Lower cam 69 begins with rope receiving groove 69A at point 71, the size of this groove is constant to the point labeled 72. At this point, the rope groove tapers as shown at 72A. Upper cam 68 has a rope engaging groove 68A of uniform size while lower cam 69 has a rope receiving groove 69A that accommodates rope 55 up to approximately the point indicated by line 72 on the side of cam 69, from which point on, its decreases progressively to the point where it no longer allows rope 55 to pass therethrough. (See groove 72A in FIG. 5.) As the rope 55 is tightened in groove 72A, handle 70 rotates to the point where handle 70 moves in an upward position causing the rope to bind and stop moving between upper cam 68 and lower cam 69. Additionally, when it is desired to release descent controller 65, lever handle 70 is pushed downward, thus rotating second cam 69 to rotate to the point where rope 55 slides easily along upper cam 68 and lower cam 69 allowing the wearer to descend at a controlled rate of speed. Portable carry-on bag 50 is provided with 200 ft. of rescue rope which is approximately 11 mm in diameter. A superior handling rescue lifeline, kern mantle rope features a composite construction of nylon and polyester fibers. The rope 55 is torque-balanced to eliminate any spin during a rappel. The continuous filament polyester sheath is braided over a continuous nylon fiber core. This provides excellent handling and knot-holding characteristics, as well as rugged protection from abrasion and cutting. The polyester sheath provides added protection for ultra-violet light and from chemicals that are harmful to nylon. The polyester sheath also reduces the strength loss and additional weight that occurs when nylon absorbs water. It has over 5,000 lbs. of tensile strength.

Figure 5:
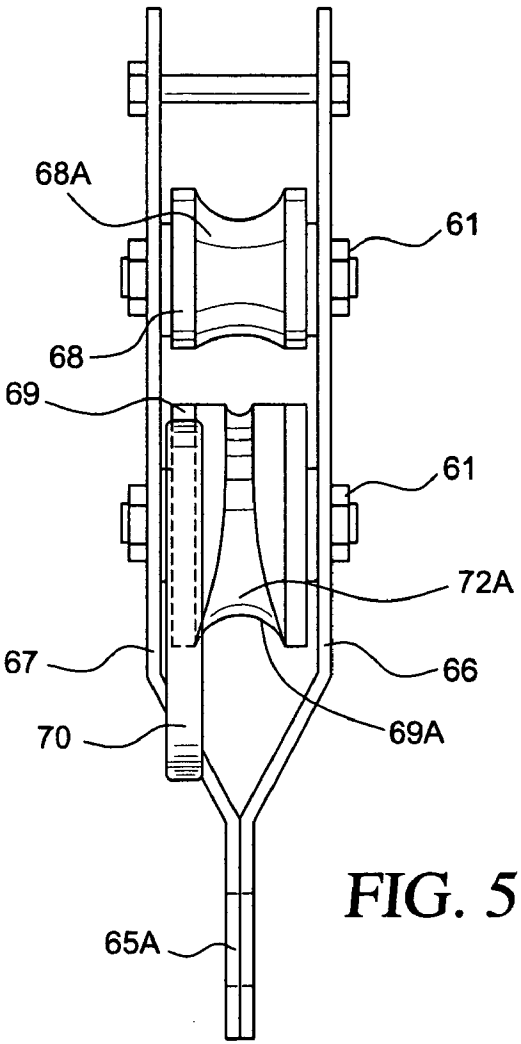
FIG. 5 is side view of the descent controller.

FIG. 5 is a side elevational view taken along the plane 5-5 of FIG. 4 and illustrates grooves 68A, 69A and tapering groove 72A, it also illustrates the engagement of handle 70 with side plate 66 when descent controller 65 is in its locked position.

Figure 6:
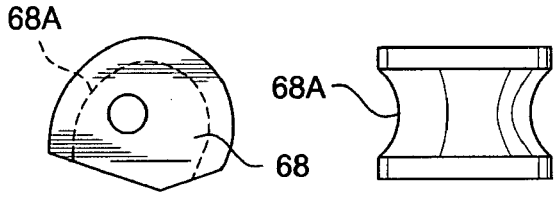
FIG. 6 is an illustration of the upper friction cam of the descent controller.

FIG. 6 is a plan view of the upper cam 68 per se.

Figure 7:
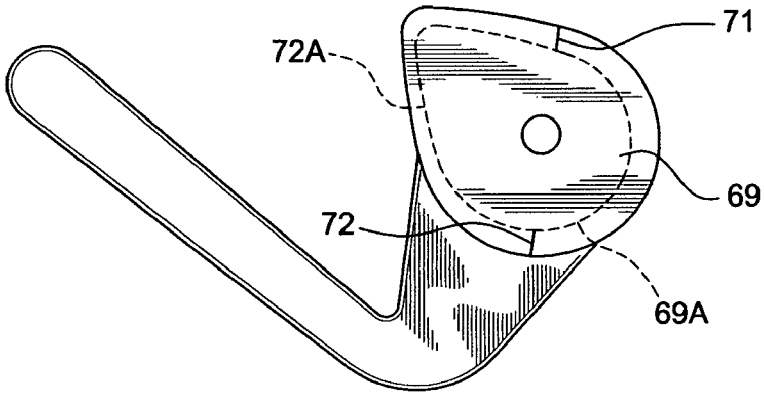
FIG. 7 is an illustration of the lower friction cam of the descent controller.

FIG. 7 is a plan view of the lower cam 69 per se.

Figure 8:
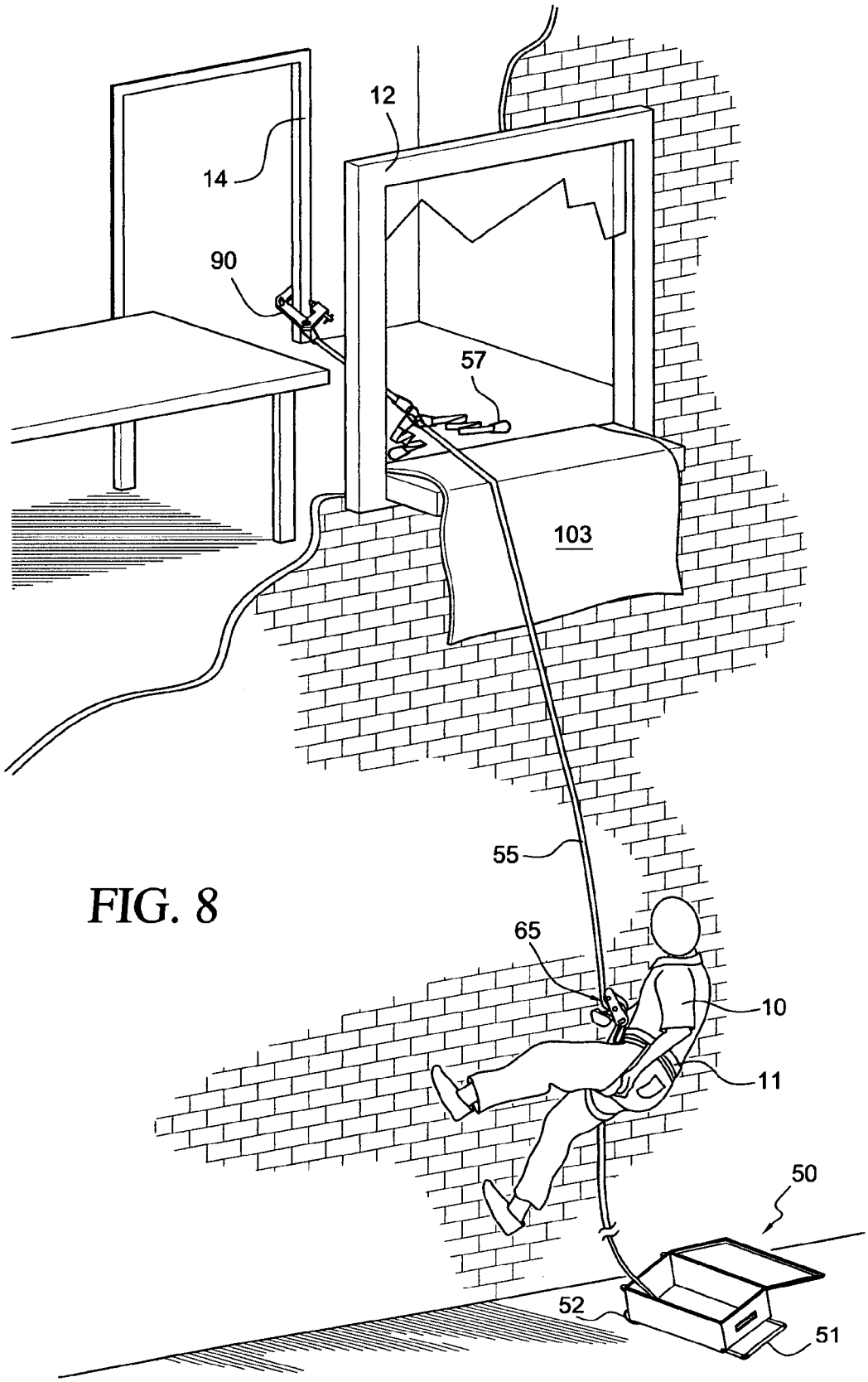
FIG. 8 is an illustration of the equipment used when evacuating a single person.

FIG. 8 is an illustration of the use of the equipment during the evacuation of a single person during an emergency situation. As shown, an evacuee 10 with a single harness 11 donned has exited through the broken window glass 12. The evacuee 10 is shown holding the descent controller 65 in his hand as he descends. Tarp 103 is shown covering as much as possible of the broken glass of the window 12 to prevent cutting of the evacuee or the rope line 55. As shown, rope 55 is connected to "C"-clamp 90 that has been securely fastened to door jamb 14. Once the evacuee 10 is ready to exit through window 12, he will throw portable carry-on bag 50 out the window 12, as shown in the lower portion of FIG. 9, where it will serve to stabilize the rope 55 as the evacuee descends.

Figure 9:
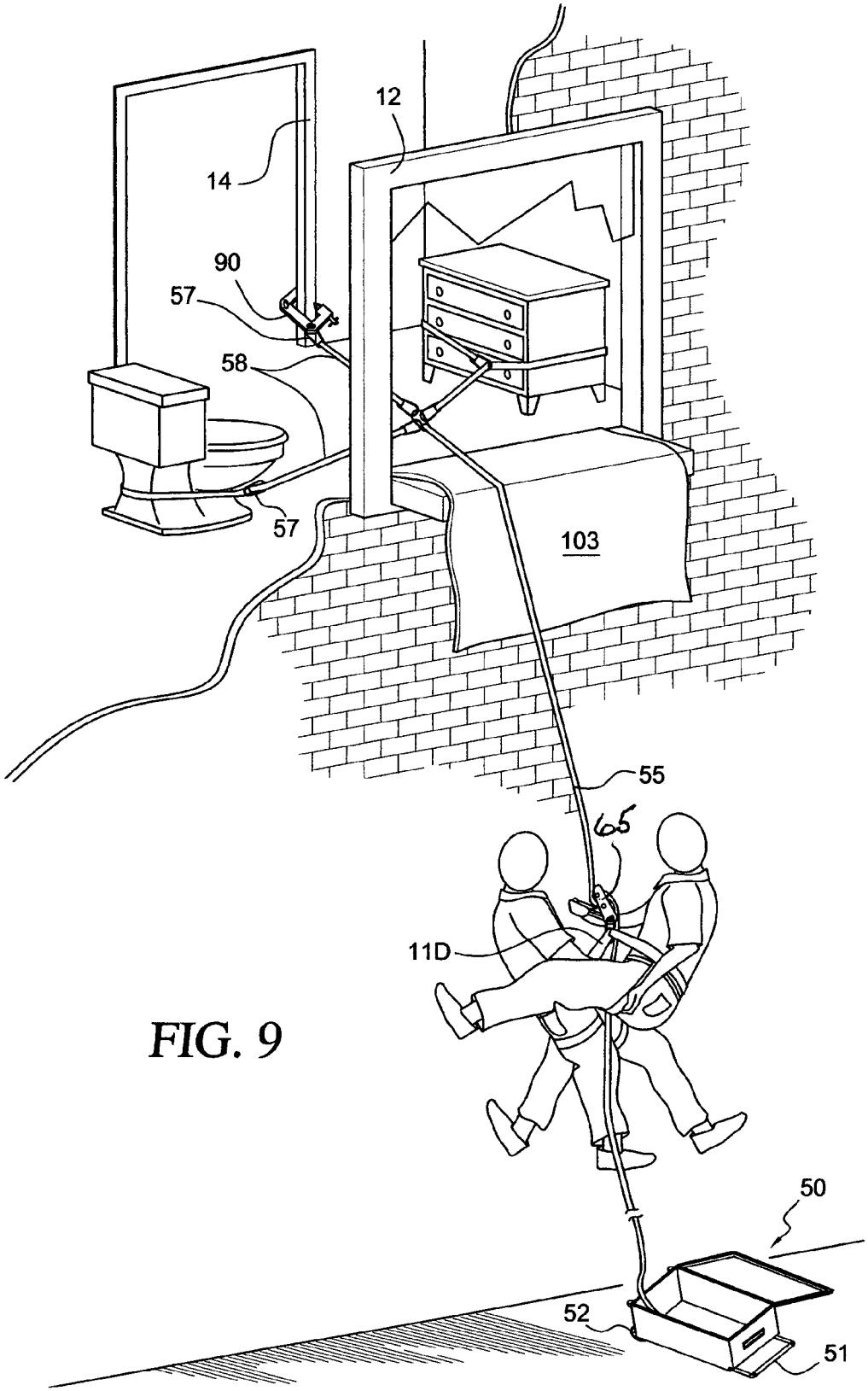
FIG. 9 is an illustration of the equipment used when evacuation two persons simultaneously.

FIG. 9 is another illustration of the equipment in use. In this view, a double harness 11D is in use. In this embodiment, there is only one descent controller 65 as in the other embodiment. The only difference is the use of the double harness 11D to accommodate the second evacuee and also the use of plural anchor straps 58 to accommodate the additional weight.

Figure 10:
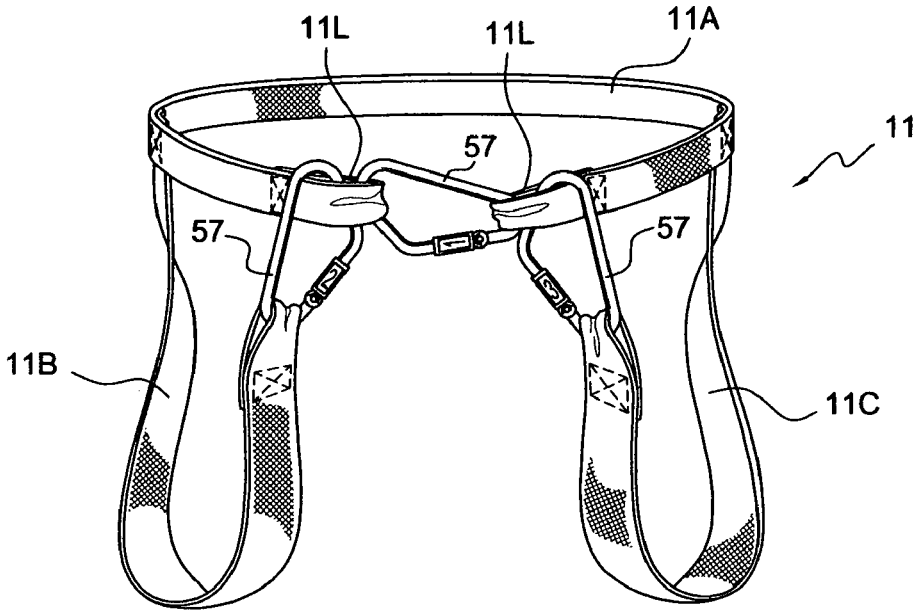
FIG. 10 is a perspective view of the harness per se.

FIG. 10 is an illustration of the single harness per se. As illustrated, harness 11 is for use by a single evacuee and comprises a waist belt portion 11A that includes loops 11L formed on each end thereof and enclosed by a snap link 57 that is color coded white and embossed with the number one thereon to indicate that it is the waist strap. Similarly, there is a right leg strap 11B that includes a carbineer 57 that is color coded red and embossed with the number two and also a left leg strap 11C that includes a carabineer 57 that is embossed with the number 3 and is color coded blue.

While the invention has been described in its preferred embodiment, it is to be understood that the words which have been used are words of description rather than words of limitation and that changes may be made within the purview of the appended claims without departing from the full scope or spirit of the invention. Accordingly, the present invention is to be limited only by the appended claims, and not by the foregoing specification.

Having thus described our invention, we claim:

1. An emergency evacuation kit usable in escaping from a multi-story building having an elevated room with at least one window, comprising:

a portable carry-on luggage bag, wherein the bag is sized to allow carry-on storage thereof in an overhead storage bin of an aircraft or in an underneath seat storage area of an aircraft, wherein the bag includes a main compartment, an extendible handle, wheels, and a lid portion, wherein the lid portion is integral with a side wall of the main compartment, wherein the lid portion includes a zipper portion adapted to securely fasten the lid portion to other side walls of the main compartment in closing the main compartment, wherein the bag includes therein a predetermined length of rope, an anchor portion, a harness portion, and a descent controller, wherein the anchor portion is adapted to securely fasten a first end of the rope with at least one stationary structure in the building, wherein a second end of the rope is fastened with the bag, wherein at least a part of the rope is arranged into a plurality of bundles of folded rope, wherein the bundles are successively spaced along the rope, wherein each respective bundle is held together by at least one rubber band which is engagingly connected only to the rope of that respective bundle, wherein with the first end of the rope securely fastened with the at least one stationary structure, descent of the bag outside of a window of the room enables the bundles to unfold in succession, beginning with the nearest bundle to the first end of the rope, wherein during the descent of the bag, each respective bundle that becomes the nearest bundle to the first end of the rope, has both the rope therein unfold, and the at least one rubber band become disconnected from the rope, wherein a disconnected rubber band is free to descend independently of the rope and the bag, wherein the harness portion is configured to be worn by a user of the kit, wherein the descent controller is adapted to connect the harness portion to the rope, wherein the descent controller is hand operable by the user to control rate of user descent down the rope, wherein the bag is of a weight adapted to contribute to stabilization of the rope during user descent.

2. The kit according to claim 1 wherein each of the anchor portion, the harness portion, and the descent controller are operatively connected with the rope.

3. The kit according to claim 1 wherein the anchor portion comprises a C-clamp including a rotatable threaded rod.

4. The kit according to claim 3 wherein the C-clamp includes a fixed pointed conical head portion, wherein the threaded rod includes a movable pointed conical head portion positioned opposite the fixed pointed conical head portion, wherein the movable pointed conical head portion and the fixed pointed conical head portion point toward each other, wherein the threaded rod is adapted to be rotated to cause the movable pointed conical head portion to move toward engagement with the fixed pointed conical head portion, wherein movement of the pointed conical head portion toward engagement with the fixed pointed conical head portion is operative to securely fasten the C-clamp to at least one stationary structure in the building.

5. The kit according to claim 1 wherein the first end of the rope is securely fastened with the anchor portion.

6. The kit according to claim 1 wherein the harness portion is a single harness that will support a single evacuee.

7. The kit according to claim 1 wherein the harness portion comprises both a first harness for use by a first evacuee and a second harness for use by a second evacuee.

8. The kit according to claim 1 wherein the harness portion includes a user harness, wherein the user harness comprises a plurality of color coded strap loops, wherein a first strap loop is colored white and is directed to a user waist, wherein a second strap loop is colored red and is directed to a user right leg, wherein a third strap loop is colored blue and is directed to a user left leg.

9. The kit according to claim 1 wherein the rope is at least 200 feet in length.

10. The kit according to claim 1 wherein the rope includes a polyester sheath that provides protection against water absorption and ultra violet light, wherein the bag further includes therein a tarp adapted to provide protection to the rope against broken glass.

11. The kit according to claim 1 wherein the descent controller comprises:

first and second cams operably mounted between a pair of first and second plates, a plurality of bolts maintaining the plates in parallel relation and serving as the axis of rotation of the cams, wherein the first cam comprises a partial peripheral rope-receiving groove, wherein the second cam comprises a partial peripheral groove followed by a tapering portion, wherein the partial peripheral groove corresponds to the partial peripheral rope-receiving groove for a portion of the second cam periphery, wherein application of a downward load to a rope in the descent controller will force the rope into the tapering portion which prevents further downward movement of the descent controller relative to the rope.

12. An emergency evacuation kit usable in escaping from a multi-story building having an elevated room with at least one window, comprising:

a portable carry-on luggage bag, wherein the bag is sized to allow carry-on storage thereof in an overhead storage bin of an aircraft or in an underneath seat storage area of an aircraft, wherein the bag includes a main compartment, an extendible handle, wheels, and a lid portion, wherein the lid portion is integral with a side wall of the main compartment, wherein the lid portion is securely fastenable to other side walls of the main compartment in closing the main compartment, wherein the bag includes therein a predetermined length of rope, an anchor portion, at least one harness, and a descent controller, wherein the rope includes a first end and a second end, wherein the first end is securely fastenable with the anchor portion, wherein the anchor portion is securable to at least one stationary structure in the building, wherein the second end is fastened with the bag, wherein at least a part of the rope is arranged into a plurality of bundles of folded rope, wherein the bundles are successively spaced along the rope, wherein each respective bundle is held together by at least one band which is engagingly connected only to the rope of that respective bundle, wherein with the anchor portion secured to the at least one stationary structure and the first end fastened with the anchor portion, descent of the bag outside of a window of the room enables the bundles to unfold in succession, beginning with the nearest bundle to the first end, wherein during the descent of the bag, each respective bundle that becomes the nearest bundle to the first end, has both the rope therein unfold, and the at least one band become disconnected from the rope, wherein a disconnected band is free to descend independently of the rope and the bag, wherein the at least one harness includes a first user harness, wherein the first user harness is configured to be worn by a user of the kit, wherein the first user harness is connected with the descent controller, wherein the descent controller is connected to the rope and is hand operable by the user to control rate of user descent down the rope, wherein the bag is of a weight adapted to contribute to stabilization of the rope during user descent.

13. The kit according to claim 12 wherein the at least one band comprises at least one rubber band.

14. The kit according to claim 13 wherein the first end is securely fastened with the anchor portion.

15. The kit according to claim 14 wherein the lid portion includes a zipper portion adapted to securely fasten the lid portion to the other side walls.

16. The kit according to claim 12 wherein the anchor portion comprises a C-clamp including a rotatable threaded rod.

17. The kit according to claim 16 wherein the C-clamp includes a fixed pointed conical head portion, wherein the threaded rod includes a movable pointed conical head portion positioned opposite the fixed pointed conical head portion, wherein the movable pointed conical head portion and the fixed pointed conical head portion point toward each other, wherein the threaded rod is adapted to be rotated to cause the movable pointed conical head portion to move toward engagement with the fixed pointed conical head portion, wherein movement of the pointed conical head portion toward engagement with the fixed pointed conical head portion is operative to securely fasten the C-clamp to at least one stationary structure in the building.

18. An emergency evacuation kit for use in escaping from a multi-story building having an elevated room with at least one window, comprising:

a portable carry-on luggage bag, wherein the bag is sized to allow carry-on storage thereof in an overhead storage bin of an aircraft or in an underneath seat storage area of an aircraft, wherein the bag includes a main compartment, an extendible handle, wheels, and a lid portion, wherein the lid portion is integral with a side wall of the main compartment, wherein the lid portion is securely fastenable to other side walls of the main compartment in closing the main compartment, wherein the bag includes therein:

a predetermined length of rope, wherein the rope includes a first rope end and a second rope end, wherein the first rope end is fastened to the bag, wherein the rope is folded into a plurality of bundles, wherein the bundles are successively spaced along the rope, wherein each respective bundle is held together by at least one band which is engagingly connected only to the rope of that respective bundle, a rope anchor portion, wherein the rope anchor portion comprises a C-clamp, wherein the C-clamp includes a fixed pointed conical head portion, wherein the C-clamp includes a threaded rod, wherein the threaded rod includes a movable pointed conical head portion, wherein the movable pointed conical head portion is positioned opposite the fixed pointed conical head portion, wherein the movable pointed conical head portion and the fixed pointed conical head portion point toward each other, wherein the threaded rod is adapted to be rotated to cause the movable pointed conical head portion to move toward engagement with the fixed pointed conical head portion, wherein movement of the pointed conical head portion toward engagement with the fixed pointed conical head portion is operative to securely fasten the C-clamp to at least one stationary structure in the building, at least one user harness, wherein the at least one user harness is configured to be worn by at least one user of the kit, a descent controller, wherein the descent controller is engageable with the rope, wherein the descent controller is hand operable by a user of the kit to control rate of user descent down the rope, wherein the bag is of a weight adapted to contribute to stabilization of the rope during user descent, a plurality of carabiners, wherein at least one first carabiner is adapted to fasten the at least one user harness to the descent controller, wherein at least one second carabiner is adapted to fasten the C-clamp to the second rope end, wherein with the second rope end fastened to the C-clamp and the C-clamp fastened to the at least one stationary structure, descent of the bag outside of a window of the room enables the bundles to unfold in succession, beginning with the nearest bundle to the second rope end, wherein during the descent of the bag, each respective bundle that becomes the nearest bundle to the second rope end, has both the rope therein unfold, and the at least one band break away from being connected to the rope, wherein a broken away band is free to descend independently of the rope and the bag.

19. The kit according to claim 18 wherein each of the rope anchor portion, the at least one user harness, the descent controller, and the plurality of carabiners are operatively connected with the rope.

20. The kit according to claim 19 wherein the bag further includes therein:

at least one anchoring strap, wherein the at least one anchoring strap is connected to the at least one second carabiner, wherein the at least one anchoring strap is positioned intermediate the rope and the C-clamp.

21. The kit according to claim 18 wherein the lid portion includes a zipper portion adapted to securely fasten the lid portion to the other side walls.

22. The kit according to claim 18 wherein the at least one band comprises at least one rubber band.

* * * * *